US009924253B2

(12) United States Patent
Kim et al.

(10) Patent No.: US 9,924,253 B2
(45) Date of Patent: Mar. 20, 2018

(54) MICROPHONE SENSOR

(71) Applicant: Hyundai Motor Company, Seoul (KR)

(72) Inventors: Hyunsoo Kim, Seoul (KR); Ilseon Yoo, Seoul (KR)

(73) Assignee: Hyundai Motor Company, Seoul (KR)

( * ) Notice: Subject to any disclaimer, the term of this patent is extended or adjusted under 35 U.S.C. 154(b) by 72 days.

(21) Appl. No.: 14/937,215

(22) Filed: Nov. 10, 2015

(65) Prior Publication Data

US 2017/0013339 A1 Jan. 12, 2017

(30) Foreign Application Priority Data

Jul. 7, 2015 (KR) ..... 10-2015-0096816

(51) Int. Cl.

| | |
|---|---|
| ***H04R 1/02*** | (2006.01) |
| ***H04R 1/04*** | (2006.01) |
| ***H04R 1/08*** | (2006.01) |

(52) U.S. Cl.

CPC ..... *H04R 1/04* (2013.01); *H04R 1/08* (2013.01); *H04R 2201/003* (2013.01)

(58) Field of Classification Search

CPC ..... H04R 1/04; H04R 1/08; H04R 2201/003

USPC ..... 381/91, 111, 174, 175, 190, 191, 355, 381/398; 257/710, 265, 334, 337, 476, 257/491; 379/428.01, 420.03, 433.03

See application file for complete search history.

(56) References Cited

U.S. PATENT DOCUMENTS

| | | | | |
|---|---|---|---|---|
| 7,940,944 | B2 * | 5/2011 | Song | H04R 19/016 381/174 |
| 8,433,084 | B2 * | 4/2013 | Conti | B81B 37/0061 381/174 |
| 2010/0303273 | A1 * | 12/2010 | Sawada | H04R 1/406 381/361 |
| 2013/0034257 | A1 * | 2/2013 | Doller | H04R 19/005 381/361 |
| 2014/0008740 | A1 * | 1/2014 | Wang | B81C 1/00246 257/416 |
| 2015/0146894 | A1 * | 5/2015 | Ng | B81C 1/0023 381/175 |

FOREIGN PATENT DOCUMENTS

| | | | |
|---|---|---|---|
| JP | 2012-175336 | A | 9/2012 |
| KR | 2007-0032373 | A | 3/2007 |
| KR | 2011-0072990 | A | 6/2011 |
| KR | 10-1109102 | B1 | 1/2012 |
| KR | 2013-0122263 | A | 11/2013 |
| KR | 10-1339909 | B1 | 12/2013 |
| KR | 10-2015-0060469 | A | 6/2015 |

* cited by examiner

*Primary Examiner* — William A Jerez Lora

(74) *Attorney, Agent, or Firm* — Mintz Levin Cohn Ferris Glovsky and Popeo, P.C.; Peter F. Corless

(57) ABSTRACT

A microphone sensor provides, a receiving space disposed on a cover and a control module and positioned with a sound sensing module in the receiving space. The microphone sensor includes a cover having a receiving groove formed at a lower portion and an air inlet that a sound signal flow in through within a control module coupled to the lower portion of the cover. Furthermore, a sound sensing module is coupled to the control module and positioned at the receiving groove.

4 Claims, 4 Drawing Sheets

MICROPHONE SENSOR

CROSS-REFERENCE TO RELATED APPLICATION

This application claims priority to and the benefit of Korean Patent Application No. 10-2015-0096816 filed in the Korean Intellectual Property Office on Jul. 7, 2015, the entire contents of which are incorporated herein by reference.

BACKGROUND (a) Field of the Invention

The present invention relates to a microphone sensor, and more specifically, relates to a microphone sensor that has a receiving space based on a cover and a control module and is positioned with a sound sensing module within the receiving space.

(b) Description of the Related Art

Generally, a microphone sensor converts sound into an electrical signal and has recently been gradually downsized. The microphone sensor provides good electromagnetic and audio performance, reliability, and operability. Accordingly, a microphone sensor using micro-electro-mechanical system (MEMS) technology has been developed. The MEMS microphone sensor is manufactured using a semiconductor batch process. The MEMS microphone sensor has strong tolerance to prevent moisture and heat, compared with a conventional electret condenser microphone (ECM), and can be down-sized and integrated into a signal processing circuit. Additionally, the MEMS microphone sensor has excellent sensitivity and low performance deviation for each product compared with a conventional ECM.

Further, the MEMS microphone sensor may be classified as either a piezoelectric MEMS microphone sensor or a capacitive MEMS microphone sensor. The piezoelectric MEMS microphone sensor is formed with a vibration film, and when the vibration film is adjusted by an external sound (e.g., music), an electrical signal occurs due to a piezoelectric effect and thus a sound pressure is measured. The capacitive MEMS microphone sensor is formed with a fixed film and a vibration film. Accordingly, when a sound (e.g., music) is applied from the exterior to the vibration film, while a gap between the fixed film and the vibration film is adjusted, a capacitance value changes. The sound pressure is changed into an electrical signal at this time.

However, in the conventional microphone sensor, a sound sensing module and a control module are disposed horizontally on a substrate of a cover to be packaged. The sound sensing module and the control module are electrically connected by wire bonding and the size of the microphone sensor and a parasitic component are large. Even if a method of vertical deposition to reduce the size of the microphone sensor is used, there is a drawback that an air inlet should be formed.

The above information disclosed in this section is merely for enhancement of understanding of the background of the invention and therefore it may contain information that does not form the prior art that is already known in this country to a person of ordinary skill in the art.

SUMMARY

An exemplary embodiment of the present invention provides a microphone sensor having a receiving space through a cover and a control module and may include a sound sensing module within the receiving space.

In an exemplary embodiment of the present invention, a microphone sensor may include a cover having a receiving groove formed at a lower portion and an air inlet which a sound signal may flow, a control module coupled to the lower portion of the cover, and a sound sensing module coupled to the control module and positioned at the receiving groove provided therein. The control module may include a circuit unit formed within the receiving groove.

In some exemplary embodiments, the sound sensing module may be electrically connected to the circuit unit of the control module via the contact unit. The contact unit may include a transmitting unit formed at both sides of a substrate of the sound sensing module, and a coupling unit having a first side coupled to the transmitting unit and the lower portion of the sound sensing module and a second side coupled to the control module.

The transmitting unit may include a penetration aperture formed at both sides of a substrate of the sound sensing module, and a filler disposed within the penetration aperture. The contact unit may be coupled to the coupling unit, and may further include a pad formed within the control module. The air inlet may be formed on at least a first side of an upper portion, a right and a left portion, and both sides of the cover. The cover may be made of at least one material among a metal, a Flame Retardant 4 (e.g., FR4), and a ceramic.

In another exemplary embodiment of the present invention, a microphone sensor may include a control module that may have a receiving groove formed at a first side, a cover that covers the receiving groove and coupled to the first side of the control module, and a sound sensing module positioned at the receiving groove provided therein. The control module may further include a circuit unit formed at a second side adjacent to (e.g. opposite) to the receiving groove. The cover may include an air inlet a sound signal that inflows and may be formed at a position that corresponds to the sound aperture of the sound sensing module. The sound sensing module may be coupled to the cover within the receiving groove, and may be electrically connected to the circuit unit of the control module through the contact unit.

The contact unit may include a transmitting unit that may be formed at both sides of a substrate of the sound sensing module, a connection portion formed at both sides of the control module with reference to the receiving groove, and a coupling unit that connects the transmitting unit and the connection portion.

The control module may include an air inlet that the sound signal flow in and may be formed at a position that corresponds to the sound aperture of the sound sensing module. The sound sensing module may be coupled to the control module within the receiving groove, and may be electrically connected to the circuit unit of the control module through the contact unit. The contact unit may include a transmitting unit that may be formed at a first side and a second side of a substrate of the sound sensing module that may be respectively coupled to a vibration film and a fixing film of the sound sensing module. A coupling unit may be coupled to the transmitting unit and may be formed beneath (e.g., under) the sound sensing module. A connection portion may electrically connect the vibration film and the fixing film of the sound sensing module and the circuit unit of the control module through the coupling unit and may be positioned at the lower portion in which the sound sensing module may be formed within the control module with reference to the air inlet.

The cover may be made of at least one material among the metal, the Flame Retardant 4, and the ceramic. In an exemplary embodiment, the sound sensing module may be positioned within the receiving space provided through the cover and the control module to reduce the microphone sensor size and the manufacturing cost. Further, in an exemplary embodiment, the sound sensing module and the control module may be electrically connected through the contact aperture to simplify the manufacturing process and transmit the signal minimizing the distance, thereby minimizing the parasitic component and improving the electrical performance.

BRIEF DESCRIPTION OF THE DRAWINGS

The above and other features of the present disclosure will be apparent from the following detailed description when taken in conjunction with the accompanying drawings, in which:

FIG. 3 is an exemplary cross sectional view showing a microphone sensor according to an exemplary embodiment of the present invention; and.

DETAILED DESCRIPTION

Figure 1:
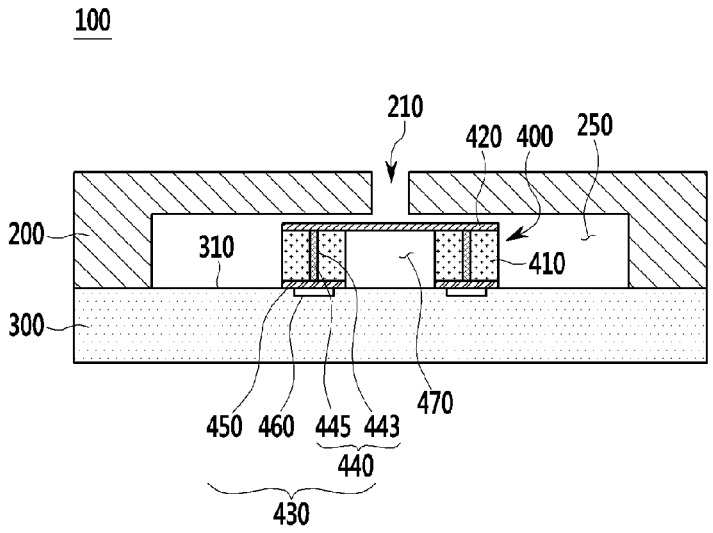
FIG. 1 is an exemplary cross sectional view showing a microphone sensor according to an exemplary embodiment of the present invention.

The operation principles of a microphone sensor according an exemplary embodiment of the present invention will be described hereafter with reference to the accompanying drawings. However, the drawings to be described below and the following detailed description relate to one preferred exemplary embodiment of various exemplary embodiments for effectively explaining the characteristics of the present invention. Therefore, the present invention should not be construed as being limited to the drawings and the following description.

In addition, in the following exemplary embodiments, the terminologies are appropriately changed, combined, or divided so that those skilled in the art can clearly understand them, in order to efficiently explain the main technical characteristics of the present invention, but the present invention is not limited thereto.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, In order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Figure 2:
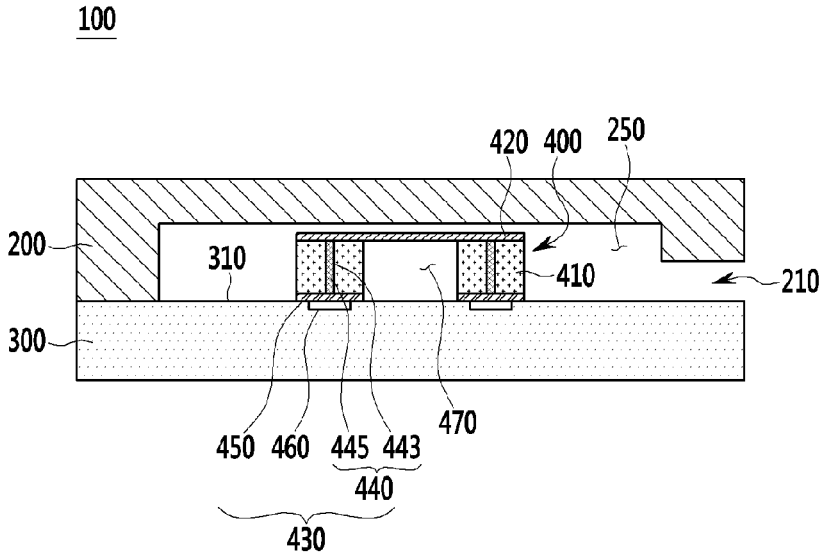
FIG. 2 is an exemplary cross sectional view showing a microphone sensor according to an exemplary embodiment of the present invention.

FIG. 1 is an exemplary cross sectional view showing a microphone sensor according to an exemplary embodiment of the present invention, and FIG. 2 is an exemplary cross sectional view showing a microphone sensor according to another exemplary embodiment of the present invention. Referring to FIG. 1 and FIG. 2, a microphone sensor 100 may include a cover 200, a control module 300, and a sound sensing module 400. The cover 200 may be coupled to an upper portion of the control module 300 and may include an air inlet 210. The air inlet 210 may be a path that a sound signal that flow in generated in an exterior environment. The air inlet 210 may be formed at least one among the upper portion and left and right sides of the cover 200. For example, the air inlet 210, as shown in FIG. 1, may be formed at the upper portion of the cover 200. In particular, the air inlet 210, as shown in FIG. 1, may be formed at the position that corresponds to a sound aperture 470 of the sound sensing module 400. Additionally, the air inlet 210 may be formed at either the right or left of the cover 200 of FIG. 2.

The sound signal may be generated by a voice processing device. In other words, the voice processing device may be configured to process the sound within a vehicle, and may be at least one device among a speech recognition device, a hands-free device, and a portable communication terminal. The voice processing device may be configured to recognize the voice when a driver provides an instruction by voice, and may execute the order received from driver. The hands-free device may be coupled to portable communication terminals via local wireless communication, to allow speaker recognition via the portable communication terminal in their hands The portable communication terminal, may perform a wireless phone call, may be a smart phone or a personal digital assistant (e.g., PDA).

A receiving groove 250 that may function as a predetermined receiving space may be formed under (e.g., beneath) the cover 200. The sound sensing module 400 may be formed within the receiving groove 250. The cover 200 may be formed having a cap shape (e.g., or other similar geometric configurations). The cover 200 may be made of at least one material among a metal, an Flame Retardant 4 (e.g., FR4), and a ceramic. Additionally, a cross-sectional of the cover 200 may have a polygonal shape including a circle, an ellipse, and a quadrangle.

The control module 300 may be coupled to a lower portion of the cover 200 and may have a plate shape. Accordingly, in the microphone sensor 100, the control module 300 may occupy one side of the cover 200 and may receive the cover 200 and the sound sensing module 400, thereby reducing the size of the microphone sensor 100. The control module 300 may include a circuit unit 310 formed at a first side. The circuit unit 310 may be formed on the upper surface of the control module 300 disposed within the receiving groove 250. The circuit unit 310 may be configured to receive the sound output signal from the sound sensing module 400, and may be configured to process the sound output signal to be output to an exterior environment. The circuit unit 310 may be an ASIC application specific integrated circuit (e.g., ASIC).

The control module 300 may be electrically connected to the sound sensing module 400 via a contact unit 430. The contact unit 430 may include a transmitting unit 440, a coupling unit 450, and a pad 460. The transmitting unit 440 may be formed at both sides of the substrate 410 of the sound sensing module 400. The transmitting unit 440 may be coupled to a vibration film and a fixing film of the sound sensing module 400 and may be configured receive the sound output signal from the vibration film and the fixing film. For example, the transmitting unit 440 may include a first penetration aperture 443 and a first filler 445.

The first penetration aperture 443 may be formed at both sides on the substrate 410 of the sound sensing module 400 and may penetrate the substrate 410, such that one side may be coupled to at least one of the vibration film and the fixing film and connect the other (e.g., opposite) side is coupled to the coupling unit 450. The first filler 445 may be disposed within the first penetration aperture 443 and may be made of an electrical material or the electrode. The transmitting unit 440 may be formed through a through aperture via (e.g., TSV).

The coupling unit 450 may be coupled to the sound sensing module 400 and the control module 300. In other words one side of the coupling unit 450 may be coupled to the lower portion of the sound sensing module 400, and the other (e.g., opposite) side of the coupling unit 450 may be coupled to the upper portion of the control module 300. The coupling unit 450 may be coupled to the transmitting unit 440 and may be configured to receive the sound output signal from the transmitting unit 440. The coupling unit 450 may be configured to transmit the received sound output signal to the circuit unit 310 of the control module 300 through the pad 460, or may be directly connected to the circuit unit 310 of the control module 300 to transmit the sound output signal.

The pad 460 may be coupled to the coupling unit 450 and may be formed at the upper side of the control module 300. In other words, the pad 460 may be formed at the lower portion of the coupling unit 450. The pad 460 may be configured to transmit the sound output signal from the sound sensing module 400 through the transmitting unit 440 and the coupling unit 450 to the circuit unit 310 of the control module 300.

The sound sensing module 400 may be configured to process the inflow of the sound signal through the air inlet 210 and may be configured to transmit the sound signal to the control module 300. For example, the sound sensing module 400 may receive the sound signal from the external voice processing device through the air inlet 210. The sound sensing module 400 may be positioned at the receiving space formed by the cover 200 and the control module 300. In particular, the sound sensing module 400 may be positioned at the receiving groove 250. The sound sensing module 400 may include a substrate 410 and an acoustic layer 420. The substrate 410 may be made of silicon and may be formed with the sound aperture 470.

The acoustic layer 420 may be disposed on the substrate 410. may be a layer in which the vibration film and the fixing film are formed as a single layer. A portion of the vibration film exposed by the sound aperture 470 may vibrate based on the sound signal inflow from the exterior environment. The interval between the vibration film and the fixing film by the vibrated vibration film may be adjusted, to adjust the sound signal between the vibration film and the fixing film to allow the generated sound output signal to be transmitted to the circuit unit 310 of the control module 300 through the contact unit 430. The sound sensing module 400 may be made of the MEMS technology.

Figure 3:
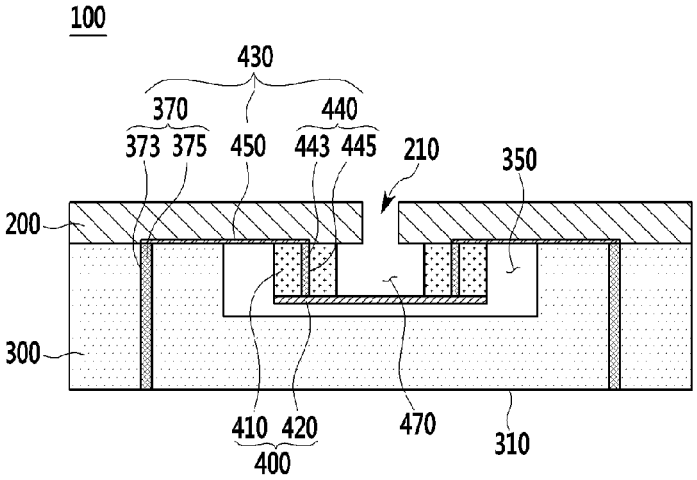

FIG. 3 is an exemplary cross sectional view showing a microphone sensor according to another exemplary embodiment of the present invention. Referring to FIG. 3, the microphone sensor 100 may include the cover 200, the control module 300, and the sound sensing module 400. The cover 200 may be coupled to one side (e.g., a first side) of the control module 300. In other words, the cover 200 may cover a receiving groove 350 of the control module 300 and may be coupled to one side of the control module 300. The cover 200 may be formed to be plate-shaped and may include the air inlet 210 that inflows the sound signal generated in the exterior environment. For example, the air inlet 210 may be formed at the position that corresponds to the sound aperture 470 of the sound sensing module 400 in the cover 200. For example, the air inlet 210, as shown in FIG. 3, may be formed on the cover 200. The cover 200 may be made of at least one material of the metal, the FR4, and the ceramic.

The control module 300 may be coupled to the cover 200 and may be configured to receive the sound sensing module 400 along with the cover 200. For this, the control module 300 may include the receiving groove 350. In other words, the receiving groove 350 may be formed at the center of the control module 300. The control module 300 may include the circuit unit 310 disposed at the opposite side in which the receiving groove 350 may be formed. The circuit unit 310 may be formed at the lower surface of the control module 300.

The sound sensing module 400 may be configured to process the sound signal that may flow in through the air inlet 210 and the sound aperture 470 and may be configured to transmit the sound to the circuit unit 310 of the control module 300. The sound sensing module 400 may include the substrate 410 and the acoustic layer 420 in which the vibration film and the fixing film may form the single layer. The substrate 410 may include the sound aperture 470 and the sound signal inflows through the sound aperture 470. The vibration film and the fixing film may be made of the single layer and may be configured to process the sound signal that may flow in to the sound aperture 470 to transmit the sound output signal to the control module 300.

The sound sensing module 400 may be positioned at the receiving space formed by the cover 200 and the control module 300. In other words, the sound sensing module 400 may be positioned at the receiving groove 350 of the control module 300. The sound sensing module 400 may be coupled to the cover 200 and disposed within the receiving groove 350. For example, the substrate 410 of the sound sensing module 400 may be coupled to the lower portion of the cover 200. The sound sensing module 400 may be positioned within the receiving groove 350 in the direction opposite to the sound sensing module 400 shown in FIG. 1 and FIG. 2.

The sound sensing module 400 may be electrically connected to the control module 300 through the contact unit 430. The contact unit 430 may include the transmitting unit 440, a connection portion 370, and the coupling unit 450. The transmitting unit 440 may be formed at the first side and the second side (e.g., both sides) of the substrate 410 of the sound sensing module 400 based on the sound aperture 470 in the sound sensing module 400. The transmitting unit 440 may include the first penetration aperture 443 and the first filler 445. The first penetration aperture 443 may be formed at the first side and the second side (e.g., both sides) with respect to the sound aperture 470, and may penetrate the substrate 410 of the sound sensing module 400 to be coupled to the acoustic layer 420 and the connection portion 370. The first filler 445 may be disposed within the first penetration aperture 443 and may be made of the electrical material or the electrode.

The coupling unit 450 may connect the transmitting unit 440 and the connection portion 370, and may transmit the sound output signal from the transmitting unit 440 to the coupling unit 450. The coupling unit 450 may be formed under (e.g., beneath) the cover 200. The connection portion 370 may be formed at the first side and the second side (e.g., both sides) of the control module 300 with respect to the receiving groove 350, and may be coupled to the coupling unit 450 and the circuit unit 310 of the control module 300. In other words, one side of the connection portion 370 may be coupled to the coupling unit 450, and the other side (e.g., opposite side) thereof may be coupled to the circuit unit 310 of the control module 300. The connection portion 370 may include a second penetration aperture 373 and a second filler 375.

The second penetration aperture 373 may be formed at the first side and the second side (e.g., both sides) of the control module 300 while penetrating the control module 300. One side (e.g., a first side or a second side) of the second penetration aperture 373 may be coupled to the coupling unit 450, and the other side may be coupled to the circuit unit 310 of the control module 300. The second filler 375, the electrode or the electrical material may be disposed within to the second penetration aperture 373 to receive the sound output signal from the sound sensing module 400 via the transmitting unit 440 and the coupling unit 450, and may be configured to transmit the received sound output signal to the circuit unit 310. The second filler 375 may be made of the same material as the first filler 445. The transmitting unit 440 and the connection portion 370 may be formed through the TSV.

Figure 4:
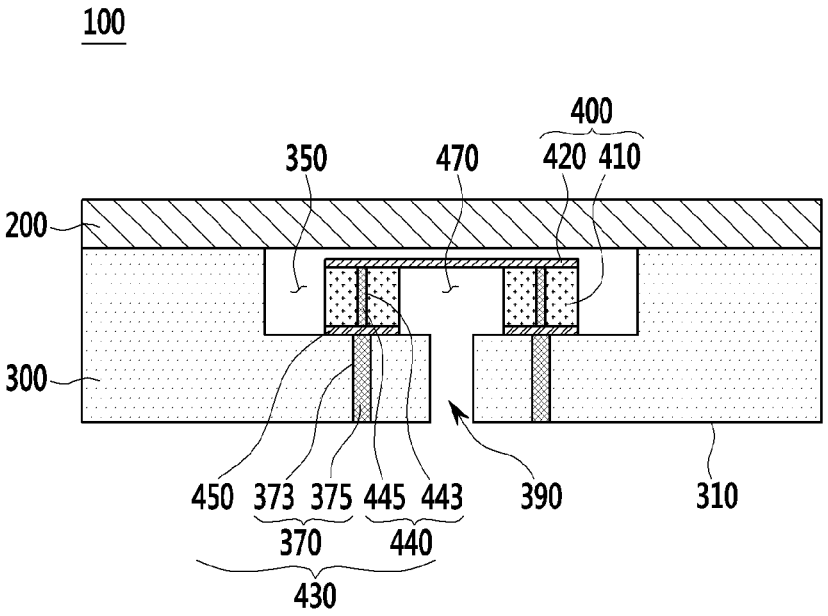
FIG. 4 is an exemplary cross sectional view showing a microphone sensor according to an exemplary embodiment of the present invention.

FIG. 4 is an exemplary cross sectional view showing a microphone sensor according to another exemplary embodiment of the present invention. Referring to FIG. 4, the microphone sensor 100 may include the cover 200, the control module 300, and the sound sensing module 400. The cover 200 may cover the receiving groove 350 and may be coupled to one side (e.g., a first side) of the control module 300. The cover 200 may be made of at least one material of the metal, the FR4, and the ceramic. The control module 300 may be coupled to the cover 200, and may include the receiving groove 350 formed at a first side (e.g., one side) and the circuit unit 310 formed at the second side (e.g., other side).

The sound sensing module 400 may be positioned at the receiving groove 350. The size and the shape of the receiving groove 350 are not limited provided the sound sensing module 400 may be received. For example, the receiving groove 350 may be formed to be cylindrical or quadrangular. The circuit unit 310 may be formed at the lower surface of the control module 300, and may process the sound output signal transmitted to the sound sensing module 400 to be output to the exterior.

The control module 300 may include an air inlet 390 to inflow the sound signal from the exterior to the sound sensing module 400. The air inlet 390 may be formed under (e.g., beneath) the control module 300, and may be formed to be penetrated from the lower surface of the control module 300 to the receiving groove 350. The air inlet 390 may be formed at a position that corresponds to the sound aperture 470 of the sound sensing module 400. In other words, the air inlet 390 and the sound aperture 470 may be formed in parallel.

The sound sensing module 400 may be configured to receive the sound signal through the air inlet 390 and the sound aperture 470 may be formed in the substrate, and may process the sound through the vibration film and the fixing film. The vibration film and the fixing film may be formed of the single layer and may be included in the acoustic layer. The sound sensing module 400 may be positioned at the receiving groove 350. The lower portion of the substrate of the sound sensing module 400 may be coupled to the control module 300 within the receiving groove 350. The sound sensing module 400 may be electrically coupled to the control module 300 through the contact unit. In other words, the sound sensing module 400 may be configured to transmit the sound output signal to the circuit unit 310 of the control module 300 through the contact unit.

The contact unit may include the transmitting unit 440, the coupling unit 450, and the connection portion 370. The transmitting unit 440 may be formed at both sides with respect to the sound aperture 470, and may include the first penetration aperture and the first filler. The transmitting unit 440 may be connected to the vibration film and the fixing film of the sound sensing module 400. The transmitting unit 440 may electrically connect the sound sensing module 400 to the circuit unit 310 of the control module 300 through the first penetration aperture and the first filler.

The coupling unit 450 may connect the transmitting unit 440 and the connection portion 370, and may be positioned under (e.g., beneath) the substrate of the sound sensing module 400. In particular, a first side (e.g., one side) of the coupling unit 450 may be coupled to the transmitting unit 440 and the second side (e.g., other side) of the coupling unit 450 may be coupled to the connection portion 370. The connection portion 370 may be coupled to the coupling unit 450 and formed at the first side and the second side (e.g., both sides) of the control module 300. For example, the connection portion 370 may be positioned at the lower portion in which the sound sensing module 400 may be formed in the control module 300 with reference to the air inlet 390. The connection portion 370 may include the second penetration aperture 373 and the second filler 375. The second penetration aperture 373 may be formed to be penetrated by the receiving groove 350 to the bottom of the control module 300, and the second filler 375 may be formed to fill the inside of the second penetration aperture 373 and may be made of the electrical material or the electrode. The transmitting unit 440 and the coupling unit 450 may be formed through the TSV.

Further, in the present invention, the vibration film and the fixing film may be formed of the single layer, however it is not limited thereto, and the vibration film and the fixing film may be separated by a predetermined interval and may be positioned at the upper and lower positions. Accordingly, in the microphone sensor according to an exemplary embodiment of the present invention, the lower portion of the cover and the control module may be connected to provide the receiving space to receive the sound sensing module, and the cover and the control module may serve as the housing function of the sound sensing module to reduce the entire size of the microphone sensor and the manufacturing cost.

While this invention has been described in connection with what is presently considered to be exemplary embodiments, it is to be understood that the invention is not limited to the disclosed exemplary embodiments, but on the contrary, is intended to cover various modifications and equivalent arrangements included within the spirit and scope of the appended claims. In addition, it is to be considered that all of these modifications and alterations fall within the scope of the present invention.

DESCRIPTION OF SYMBOLS

100: microphone sensor
200: cover
210, 390: air inlet
250, 350: receiving groove
300: control module
310: circuit unit
400: sound sensing module
410: substrate
420: acoustic layer
430: contact unit

What is claimed is:

1. A microphone sensor, comprising:

a cover including a receiving groove formed at a lower portion and an air inlet that inflows a sound signal;

a control module coupled to the lower portion of the cover; and a sound sensing module coupled to the control module and positioned at the receiving groove, wherein the control module includes a circuit unit formed within the receiving groove, wherein the sound sensing module is electrically connected to the circuit unit of the control module through a contact unit, wherein the contact unit includes: a transmitting unit formed at both sides of a substrate of the sound sensing module and a coupling unit having a first side coupled to the transmitting unit and the lower portion of the sound sensing module and a second side coupled to the control module, and wherein the transmitting unit includes a penetration aperture formed at both sides of a substrate of the sound sensing module and a filler disposed within the penetration aperture.

2. The microphone sensor of claim 1, wherein the contact unit is coupled to the coupling unit and further includes a pad formed within the control module.

3. The microphone sensor of claim 1, wherein the air inlet is formed on at least one of an upper portion, a right and a left portion, and both sides of the cover.

4. The microphone sensor of claim 1, wherein the cover is made of at least one material among a metal, an Flame Retardant 4, and a ceramic.

* * * * *